US005306092A

United States Patent [19]

Jenq

[11] Patent Number: 5,306,092

[45] Date of Patent: Apr. 26, 1994

[54] MARKING PEN WITH GRADUAL-LAYER COLOR EFFECT

[76] Inventor: Li-Chen Jenq, No. 36, Sec. 1, Jong Shan RD., Yeong Her, Taipei, Taiwan

[21] Appl. No.: 56,466

[22] Filed: May 5, 1993

[51] Int. Cl.[5] ..... B43K 1/12; B43K 5/18; B43K 8/08; B43K 27/00

[52] U.S. Cl. ..... 401/47; 401/23; 401/17; 401/35; 401/199

[58] Field of Search ..... 401/23, 28, 17, 35, 401/47, 34, 198, 199

[56] References Cited

U.S. PATENT DOCUMENTS

| | | | |
|---|---|---|---|
| 1,767,118 | 6/1930 | Bugg | 401/35 X |
| 3,481,675 | 12/1969 | Greenberg | 401/35 |
| 3,887,287 | 6/1975 | Rosh | 401/35 |

FOREIGN PATENT DOCUMENTS

| | | | |
|---|---|---|---|
| 126851 | 5/1901 | Fed. Rep. of Germany | 401/35 |
| 2459860 | 6/1976 | Fed. Rep. of Germany | 401/34 |
| 3504262 | 8/1986 | Fed. Rep. of Germany | 401/23 |
| 258999 | 10/1989 | Japan | 401/17 |

*Primary Examiner*—Danton D. DeMille
*Attorney, Agent, or Firm*—Bacon & Thomas

[57] ABSTRACT

A marking pen is fabricated so that a twin-inserted head is inserted separately into different colored ink tubes, when the ink flows from the ink tubes to the head of the pen, the colors will mix naturally in the area adjacent to the middle of the bottom end on the head of the pen, so as to produce a gradually-layered color effect and create multi-color changes to the work produced without going through a color spray finishing process.

2 Claims, 2 Drawing Sheets

MARKING PEN WITH GRADUAL-LAYER COLOR EFFECT

SUMMARY OF THE INVENTION

The present invention provides a marking pen which has a gradual-layered and strip-rainbowed color effect alongwith the function of providing temporarily enhancing the output capacity of ink by means of compressing the penholder.

The ordinary marking pens which are available in the market have only one color. In view of this defect, the inventor creates the present invention to enable the artists to make colorful advertising works conveniently. With the present invention, a longitudinal rainbow shape of gradual-layered color effect will be produced when drawing broad stripes. For instance, red and yellow color will flow separately from two ink tubes to the head of the pen to produce a belt-shaped stripe, on the upper end of which the red color will gradually change into orange color and, later on, with a rainbow effect into yellow when it reaches the lower end.

Therefore, the main object of the present invention is to provide a marking pen with a gradually-layered color effect, comprising a penholder, several different colored ink tubes, a pen cover and a head. With one bottom end serving as a plane surface, a convex groove at the middle, and the head of a pen like a double-coned body or more formed at its top end is inserted through the bottom end of the pen cover. And the different colored ink tubes are entirely separated from one another by the upper separating pieces, while the lower separating pieces are connected with a concaved groove on the head of the pen for further assembling onto the penholder for compression and holding by the hand to enable different colored ink to flow down through various conical bodies and down to the middle area at the bottom end of the head of the pen for auto color mixing, so as to ultimately produce a gradually-layered rainbow effect.

DETAILED DESCRIPTION OF THE INVENTION

Figure 1:
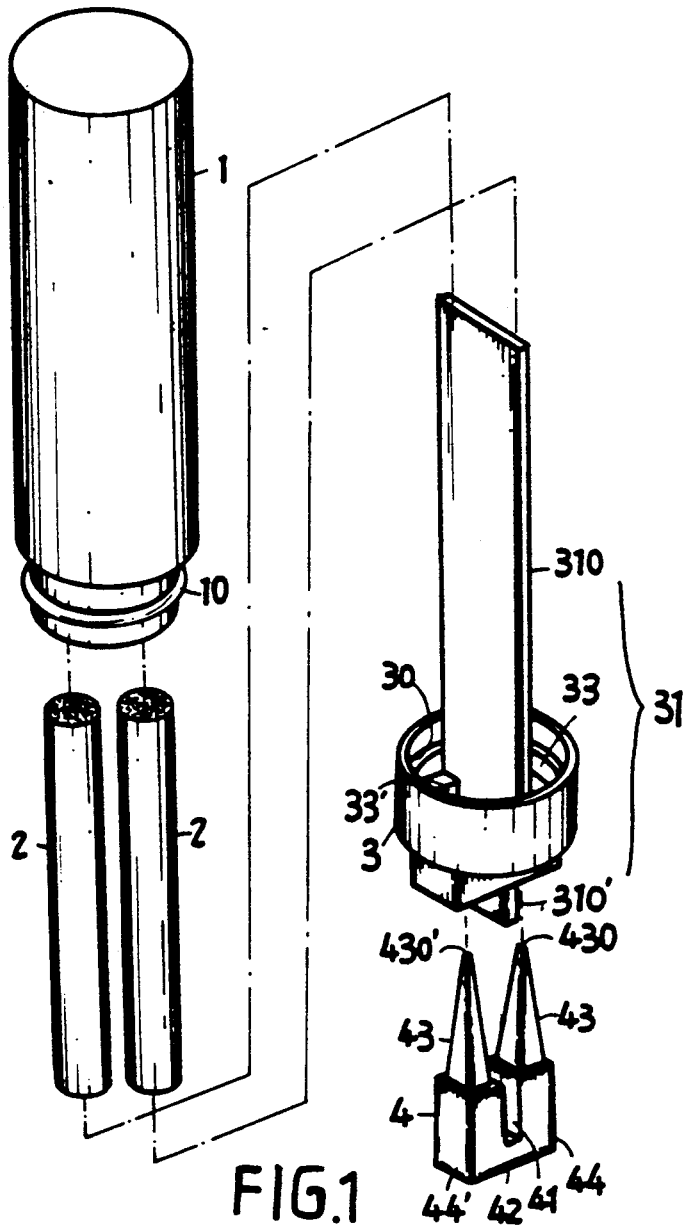
FIG. 1 is an exploded view of the present invention.
Figure 3:
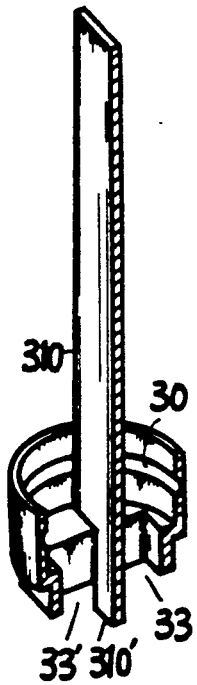
FIG. 3 is a partial perspective cross-sectional view of the present invention.

As indicated in FIGS. 1 and 3 the present invention mainly comprises a penholder 1, two different color ink tubes 2 and 2', a pen cover 3 and a pen head 4, of which the holder is integrally made of appropriately compressible material, with a convex thread 10. set on the outer edge of its opening end. Ink tubes 2 and 2' are similar in shape to that which is generally used in a marking pen. A concave annulet 30. which can be set in engagement with convex thread 10. is established in the interior of pen cover 3. In addition, a separating piece 31. is also set on its central area. Separating piece 31. is further divided into two pieces 310 i.e. the upper piece and the lower one 310'. The width of the upper separating piece 310 is equal to the interior diameter of pen cover 3, and the length is equal to the interior length of the penholder 1; while the lower separating piece 310' is equal to the width of the penhead, and at each of the two sides of lower separating piece 31' through holes 33 33' are set, of which the shape and size are made just right for penhead 4 to be sleeved firmly inside. Similar to the penhead of an ordinary marking pen, penhead 4. described herein is made of material which is featured for its permeability and absorptive function, and its lower end has a flat bottom, which serves as the part to keep contact with the surface of a paper while drawing and a concaved groove 41. for wedging with lower separating piece 310'. Furthermore, two conic bodies 43 and 43' are set on its top end. By means of the aforesaid concaved groove 41, conic bodies 43. 43' are separated to enable the inter-engagement of through holes 33. 33' which are set on the pencover. The tips of its two conic bodies also allow the insertion of different color ink tubes. Moreover, straight-direction guiding holes 430 and 430' are set at the central part of conic bodies 43. 43. as well as having plastic tubes 431. 431' set at each of the two aforementioned straight-direction guiding holes also set therein to prevent the different colors at the bottom of the penhead 4 from mixing together when the gradual-layer pen is kept unused for a long time. By means of pressing against soft penholder 1 which is made of soft material, the ink fluid is enabled to flow rapidly pass through the straight direction guiding holes 430 and 430 ' in the interior of the conic bodies 43 and 43' to rapidly increase the quantity of output ink fluid at the two sides or one side of penhead 4, so as to ultimately recover the original color contained therein.

Figure 4:
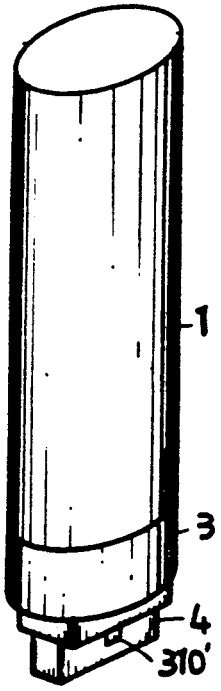
FIG. 4 is a perspective view of the present invention.
Figure 2:
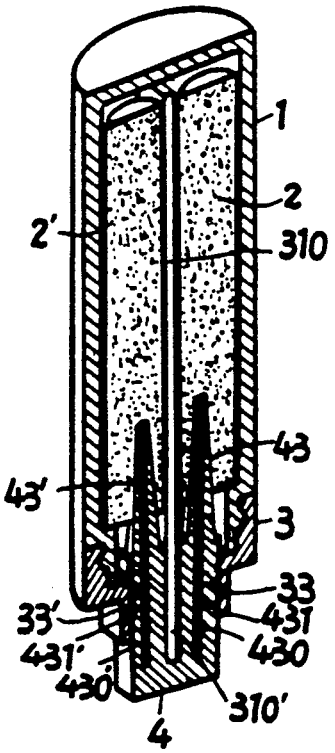
FIG. 2 is a perspective cross-sectional view of the present invention.

As indicated in FIGS. 2 and 4, when the present invention is being assembled, the two conic bodies 43. 43' are first passed through the bottom end of pen cover 3. to enable the insertion of the lower separating piece 310' of pen cover 3 into concaved groove 41. in the penhead. Besides achieving the object of strengthening the structural strength of the aforesaid penhead, this will serve as a means to prevent the ink which flows down from the penhead from mixing at a time which is regarded as too early, so that moderate color mixing will only be processed when the ink flows down to the extreme bottom end. Because of the limited space at the middle section 42. of the penhead, color mixing will not become too serious when the pen is kept unused for a long time. Therefore, the ink on the two edges 44. 44' of the bottom end of penhead 4 can still retain the original color. When it flows gradually down to the middle section, color mixing will then be gradually increased. As penhead 4 is being firmly clamped by the two through holes 33. 33', it is prevented from falling off. Two different colored ink tubes 2. 2' are then inserted separately into conic bodies 43 and 43'. Pen cover 3 is fixed under penholder 1 by means of the inter-engagement of the concaved groove 30 in the pen cover with the convex thread 10 on its outer edge. Then the two different colored ink tubes 2. 2' will be sleeved into penholder 1, and thus complete its assembly to produce a gradual-layer rainbow like effect.

I claim:

1. A gradual-layer colored marking pen comprising:

a) a hollow holder formed of compressible material for containing a plurality of color ink tubes and including an open end provided with a convex thread around an outer periphery thereof;

b) a cover including a concave annulet engageable by the convex thread, an upper separating piece receivable within the holder for separating the ink tubes from each other, and a a lower separating piece defining a plurality of through holes;

c) a head including a bottom end in the shape of a plane surface, a concave groove and a plurality of conical bodies extending upwardly from the bottom end, each conical body for receiving ink from an ink tube and transferring the ink to the bottom end, the head being engagable with the cover to dispose the conical bodies through the through holes and into the ink tubes; and d) whereby the different color inks from the ink tubes flow separately through the conical bodies to the bottom end of the head when the holder is compressed, with the lower separating piece serving to strengthen the head and preventing the different color inks from mixing prior to reaching the bottom end of the head.

2. The marking pen of claim 1 wherein each conical body further includes a tube extending therethrough for transferring ink from the ink tube to the bottom end of the head.

* * * * *